US007265498B2

(12) United States Patent
Liu

(10) Patent No.: US 7,265,498 B2
(45) Date of Patent: Sep. 4, 2007

(54) DIMMER CONTROL SYSTEM AND CONTROLLING METHOD THEREOF

(75) Inventor: Young-Way Liu, Taipei (TW)

(73) Assignee: Princeton Technology Corporation, Hsin Tien, Taipei County (TW)

( * ) Notice: Subject to any disclaimer, the term of this patent is extended or adjusted under 35 U.S.C. 154(b) by 0 days.

(21) Appl. No.: 11/474,483

(22) Filed: Jun. 26, 2006

(65) Prior Publication Data

US 2007/0120497 A1 May 31, 2007

(30) Foreign Application Priority Data

Nov. 30, 2005 (TW) ..... 94142038 A

(51) Int. Cl.
*H05B 37/00* (2006.01)

(52) U.S. Cl. ..... 315/224; 315/307; 315/DIG. 4

(58) Field of Classification Search ..... 315/224, 315/DIG. 4, DIG. 5, DIG. 7, 307
See application file for complete search history.

(56) References Cited

U.S. PATENT DOCUMENTS 5,539,281 A * 7/1996 Shackle et al. ..... 315/224
6,696,803 B2 * 2/2004 Tao et al. ..... 315/291

* cited by examiner

*Primary Examiner*—David H. Vu
(74) *Attorney, Agent, or Firm*—Birch, Stewart, Kolasch & Birch, LLP

(57) ABSTRACT

A system for controlling illumination of a fluorescent lamp includes a silicon controlled rectifier (SCR) control circuit receiving a first signal of a power source and generating an adjustment signal. A charge pump circuit receives a charge pump signal, a second signal of the power source and the adjustment signal to generate a direct current (DC) power signal. An RC attenuator attenuates the adjustment signal to generate an attenuated DC signal. A control circuit receives the attenuated DC signal and generates first and second output signals according to a first reference voltage, a second reference voltage and a power feedback signal of the fluorescent lamp. A half bridge driving circuit receives the first output signal, the second output signal and the DC power signal to generate an illuminating signal and the charge pump signal. The illumination of the fluorescent lamp is adjustable by the illuminating signal.

17 Claims, 5 Drawing Sheets

DIMMER CONTROL SYSTEM AND CONTROLLING METHOD THEREOF

BACKGROUND OF THE INVENTION

1. Field of the Invention

The present invention relates to dimmer control and in particular, to a dimmer control system and apparatus for controlling the illumination level of a fluorescent lamp.

2. Description of the Related Art

FIG. 1 shows a dimmer control circuit with a conventional silicon controlled rectifier (SCR) for an incandescent lamp RL. When switch K1 is turned on, (AC) power PS from the utility power is sent to a point A1 through resistor R2, switch K1, resistor R3 and variable resistor R1. Meanwhile, a capacitor C is charged during the positive half cycle of the AC power PS sine wave. While the voltage at point A1 in comparison with the voltage at point A reaches a turn-on voltage of the bi-directional diode Db3 and conditions at the two terminals of the SCR also meet certain turn on requirements, SCR is turned on and the incandescent lamp RL is illuminated. The incandescent lamp RL is also illuminated in the same manner during the negative half cycle of power PS sine wave.

Adjusting the resistance of the variable resistor R1 changes the charging speed for the capacitor C, the time point when the bi-directional diode Db3 is turned on, and, eventually, the turn-on angle at which SCR begins conduction. Since different turn-on angles respond to different average currents, average current through the incandescent lamp RL is controllable by adjusting the degree of the turn-on angle, such that the illumination level of the incandescent lamp is accordingly controlled or adjusted. FIG. 2 shows output waveforms of the SCR corresponding to different turn-on angles, wherein the black area in this figure indicates the conducting periods.

Unlike incandescent lamps, fluorescent lamps require an electronic ballast to regulate the flow of power. AC power cannot start the fluorescent lamp directly, and must be converted to direct current (DC) power. FIG. 3 shows a design for adjusting the illumination level of the fluorescent lamp by a SCR. In comparison with the circuit in FIG. 1, FIG. 3 has a bridge rectifier 4D and a capacitor CL, both added before the fluorescent lamp FL to convert the AC output of the SCR to DC output, which accordingly powers the fluorescent lamp FL.

When the loading of the SCR is capacitive, such as bridge rectifier 4D and capacitor CL shown in FIG. 3, the leakage of the SCR when turned off charges capacitor CL and causes reduction of the voltage across capacitor C1. Thus, the charge current of the capacitor C1 is reduced, and a phase shift between the charge current and the input of AC power PS stops voltages across the capacitor C1 from reaching the turn-on voltage of the bi-directional diode Db3 to turn on the SCR.

When the turn-on angle is small, inability of bi-directional diode Db3 and the SCR to be turned on frequently occur, such that the fluorescent light cannot function due to shortage of energy. As a result, the fluorescent lamp FL will flicker from repeated restarting.

Another conventional dimmer control circuit for a fluorescent lamp uses an extra control circuit in an electronic dimmer ballast. During power up, the electronic dimmer ballast generates a dimming signal to adjust the illumination of the fluorescent lamp. This configuration, however, requires extra circuit design to pass the dimming signal generated by the control circuit. The circuit for the fluorescent lamp, is thus complicated.

BRIEF SUMMARY OF INVENTION

The invention provides a dimmer control system for an illumination level of a fluorescent lamp, such that the power supply not only transfers power supply but also includes several control signals to adjust the illumination level of the fluorescent lamp.

An exemplary embodiment of a dimmer control system for controlling an illumination level of a fluorescent lamp comprises a SCR circuit, a charge pump circuit, a RC attenuator, a control circuit and a half bridge driving circuit. The SCR control circuit receives a first signal from the utility power (AC) and generates an adjustment signal. The charge pump circuit is coupled to the SCR control circuit, receiving a charge pump signal, a second signal from the utility power and an adjusted adjustment signal to rectify and generate a DC power signal as a DC power source for fluorescent lamp. The RC attenuator is also coupled to the SCR control circuit, attenuating the adjustment signal output from the SCR control circuit and generating an attenuated DC signal. The control circuit is coupled to the RC attenuator and the fluorescent lamp, receiving the attenuated DC signal and generating first and second output signals according to a first reference voltage, a second reference voltage and a power feedback signal of the fluorescent lamp. The half bridge driving circuit is coupled to the charge pump circuit, the control circuit and the fluorescent lamp, receiving the first output signal, the second output signal and the DC power signal to generate the charge pump signal, such that a charge pump circuit is formed in the charge pump circuit to maintain conducting of the SCR. The half bridge driving circuit generates an illuminating signal by controlling the amount of current through an external inductor based on the first output signal, the second output signal and the DC power signal. The current flow of the illuminating signal is then applied to the fluorescent lamp to adjust the illumination level thereof.

The invention also provides a controlling apparatus for a build-in electronic dimmer ballast to control an illumination level of a fluorescent lamp. The controlling apparatus comprises a charge pump circuit, an RC attenuator and a half bridge driving circuit, wherein a SCR control circuit generates an adjustment signal by adjusting a first signal of a power source, the RC attenuator receives the adjustment signal and generates an attenuated DC signal, the charge pump circuit generates a DC power signal by receiving a second signal of the power source, the adjustment signal and a charge pump signal from the half bridge driving circuit, and the half bridge driving circuit generates an illuminating signal and the charge pump signal to control the illumination level of the fluorescent lamp according to the DC power signal, a first output signal and a second output signal generated by the controlling apparatus.

The controlling apparatus further comprises a hysteretic comparator, a subtractor and a voltage controlled oscillator. The hysteretic comparator is coupled to the RC attenuator, generating an enabling signal by comparing the first reference voltage and the second reference voltage with the attenuated DC signal. The subtractor is coupled to the RC attenuator, generating a dimming signal by adjusting the attenuated DC signal in response to the first reference voltage. The voltage controlled oscillator (VCO) is coupled to the hysteretic comparator, the subtractor and the fluorescent lamp, generating the first and second output signals to the half bridge driving circuit by converting the dimming signal according to the enabling signal and a power feedback signal generated form the fluorescent lamp.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 4:
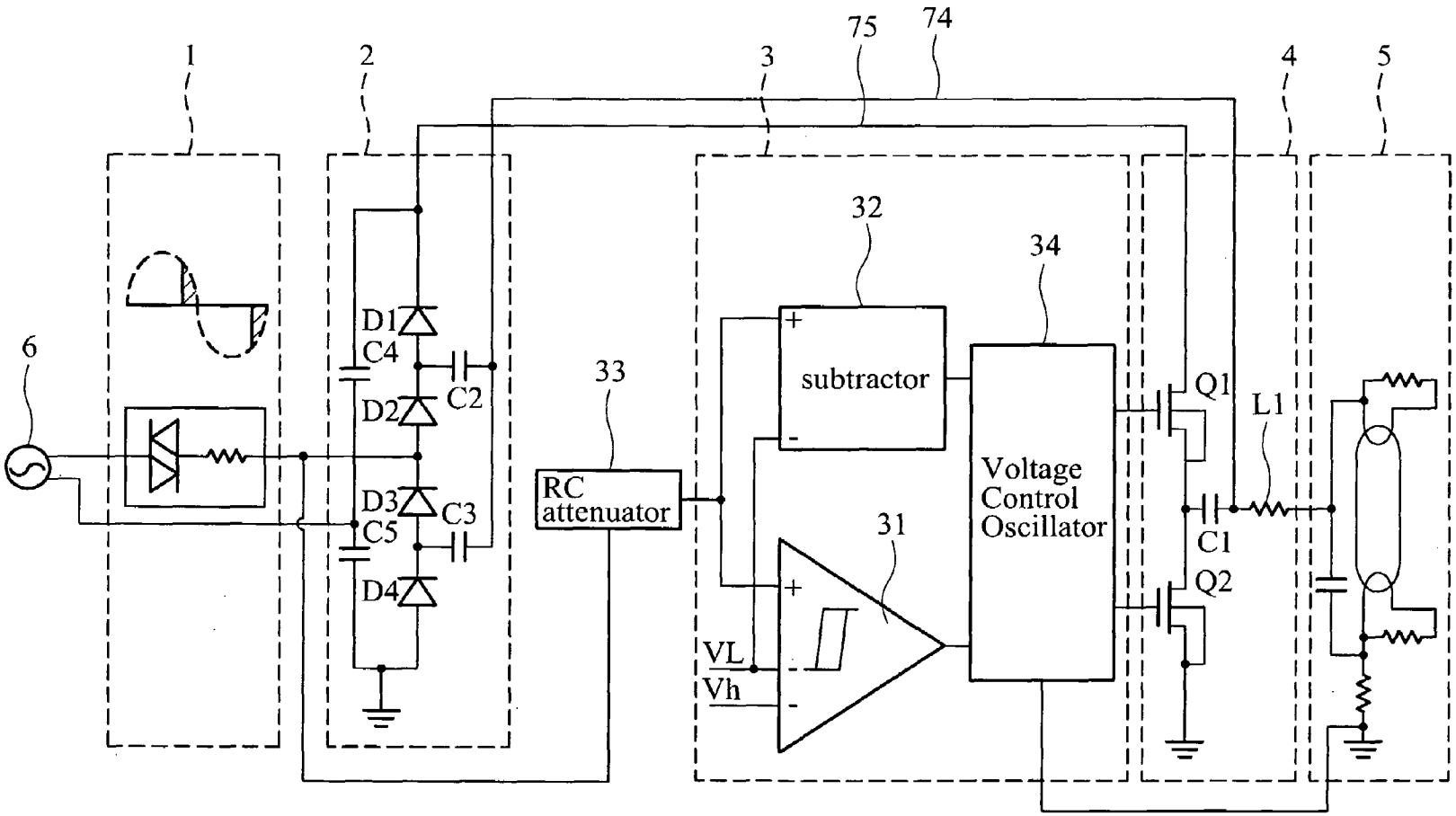
FIG. 4 is a block diagram of a dimmer control system controlling an illumination level of a fluorescent lamp according to one embodiment of the invention.

FIG. 4 is a block diagram of a dimmer control system controlling the illumination level of a fluorescent lamp according to an embodiment of the invention. As shown, the circuit comprises a SCR control circuit 1, a charge pump circuit 2, a RC attenuator 33, a control circuit 3, a half bridge driving circuit 4, and a fluorescent lamp 5.

Figure 1:
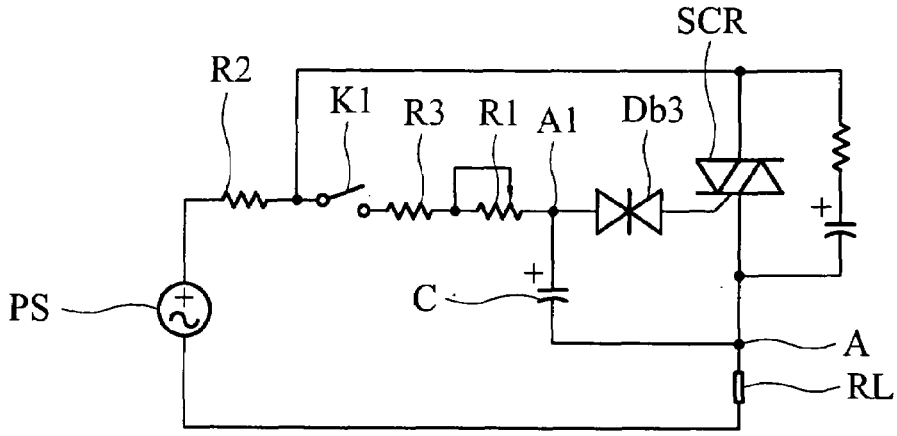
FIG. 1 (PRIOR ART)
FIG. 1 is a schematic illustration of a circuit of a conventional SCR in an incandescent lamp.
Figure 2:
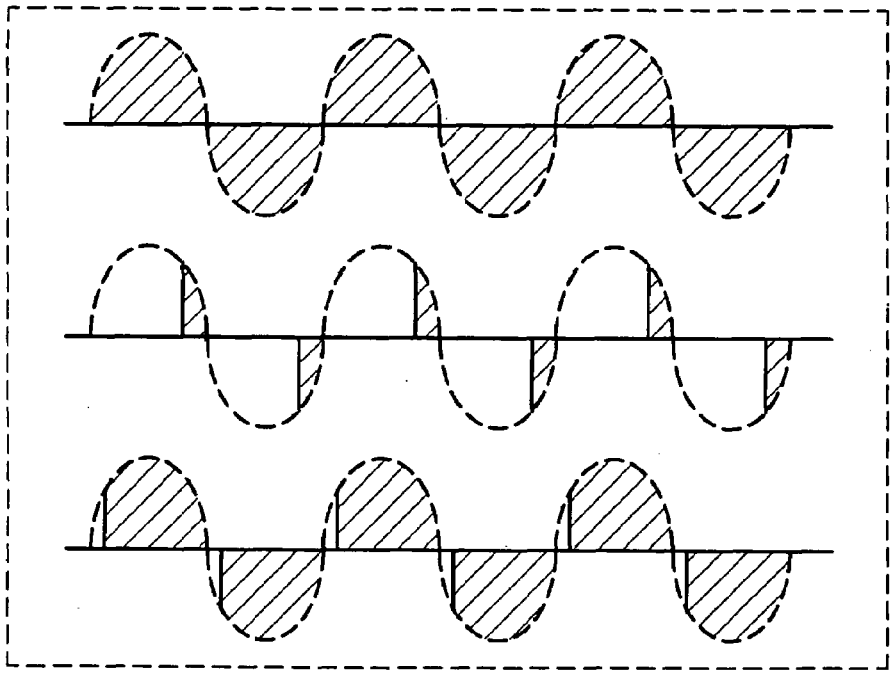
FIG. 2 is a schematic illustration of an output waveform of a SCR corresponding to different turn-on angles, the black area indicating conducting periods.
Figure 3:
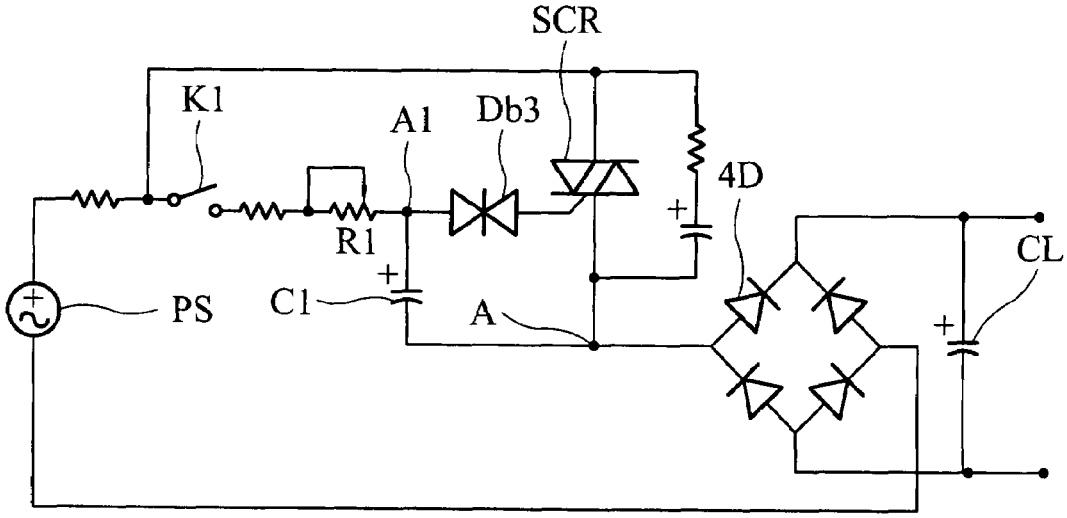
FIG. 3 is a schematic illustration of a design for adjusting the illumination level of the fluorescent lamp.

It should be noted that SCR control circuit 1 and charge pump circuit 2 used here are the same as those used in FIG. 3, and that half bridge driving circuit 4 and fluorescent lamp 5 employ conventional technology, details of which omitted herefrom for brevity. The control circuit 3 of the invention is detailed as follows.

To control the illumination of the fluorescent lamp 5, SCR control circuit 1 sets up a minimum turn-on angle ωl to maintain operation of fluorescent lamp 5, and a restart turn-on angle ωh required to restart the fluorescent lamp 5 after being turned off. When the turn-on angle of SCR control circuit 1 is less than the minimum turn-on angle ωl, the control circuit 3 sends a signal DISABLE to turn off the fluorescent lamp 5. When the fluorescent lamp 5 is off and the turn-on angle exceeds the restart turn-on angle ωh, the control circuit 3 sends a enabling signal ENABLE to turn on the fluorescent lamp 5.

Output of the charge pump circuit 2 is a DC power signal from the DC power of the fluorescent lamp 5. In one embodiment, the DC power signal is about 300V. RC attenuator 33 attenuates an adjustment signal from the SCR control circuit 1 and generates an attenuated DC signal to the hysteretic comparator 31 within the control circuit 3. For example, the attenuated DC signal can range from 0V to 4V, the degree of the turn-on angle. The hysteretic comparator 31 compares the attenuated DC signal with a first reference voltage VL, which represents the minimum turn-on angle ωl, or a second reference voltage Vh, which represents the restart turn-on angle ωh. When the voltage of the attenuated DC signal is less than the first reference voltage VL, the hysteretic comparator 31 sends the signal DISABLE to turn on a switch device. When the voltage of the attenuated DC signal is higher than the second reference voltage Vh, the hysteretic comparator 31 generates the enabling signal ENABLE to turn off the switch device.

In this case, however, effective range of the attenuated DC signal for controlling illumination is between 0V and 4V before installation of the hysteretic comparator 31 and then between VL and 4V after the hysteretic comparator 31 is installed. Therefore, the enabling signal cannot be generated in the range between 0V and VL of the attenuated DC signal, and dimming range is reduced.

Therefore, a subtractor 32 is added into the control circuit 3 of the invention, as shown in FIG. 5. The negative terminal of the subtractor 32 receives the first reference voltage VL, the positive terminal of which receives the attenuated DC signal. Substractor 32 adjusts the range of attenuated DC signal from 0~4V to 0~(4+VL)V. The attenuated DC signal is compared with the first reference voltage VL, and a dimming signal is generated after the operation of the subtractor 32. As a result, the dimming signal is compensated to from 0 to 4V.

Figure 5A:
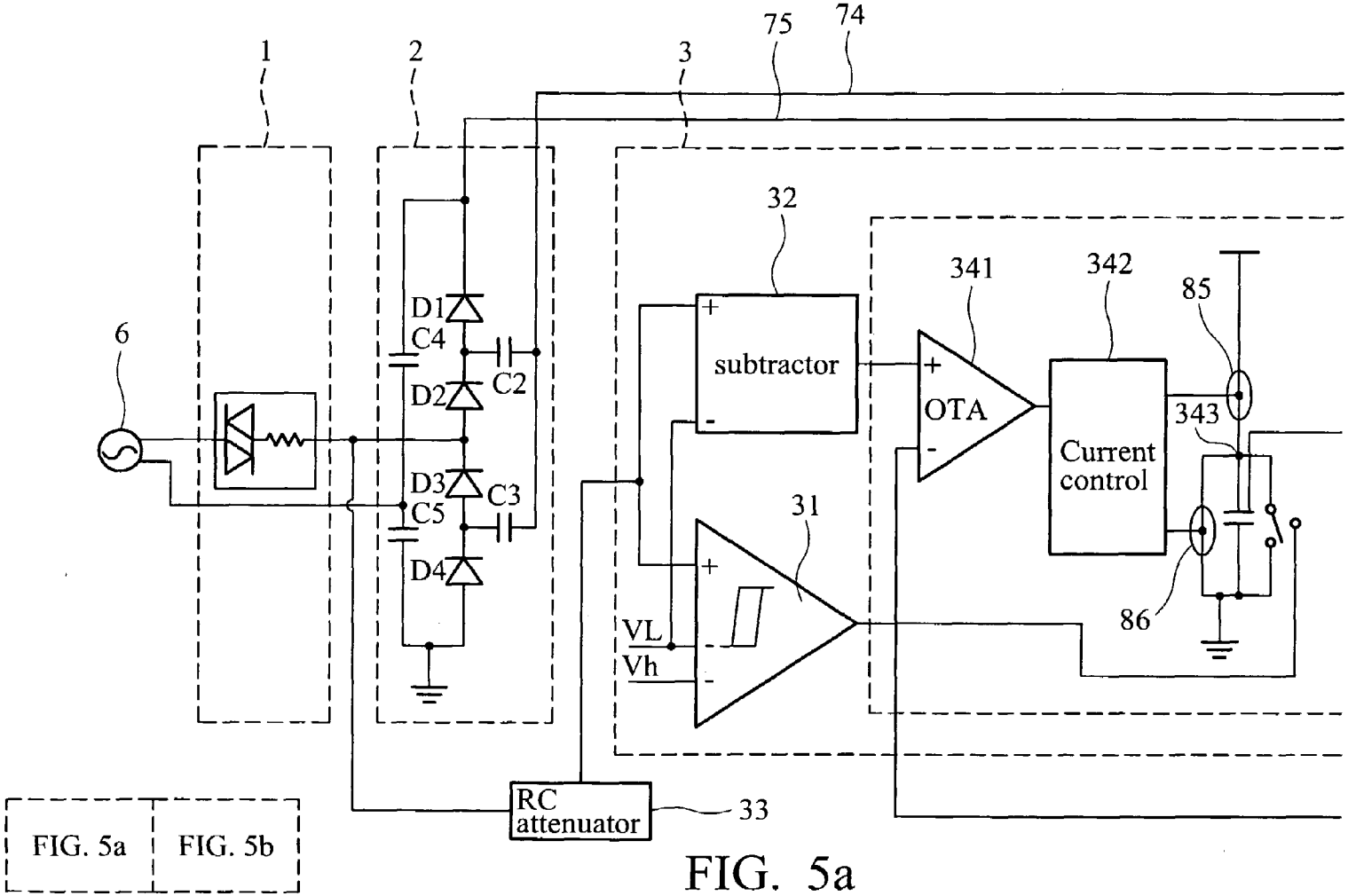
FIGS. 5*a*-5*b* is a schematic illustration of a dimmer control system controlling the illumination level of a fluorescent lamp according to another embodiment of the invention.
Figure 5B:
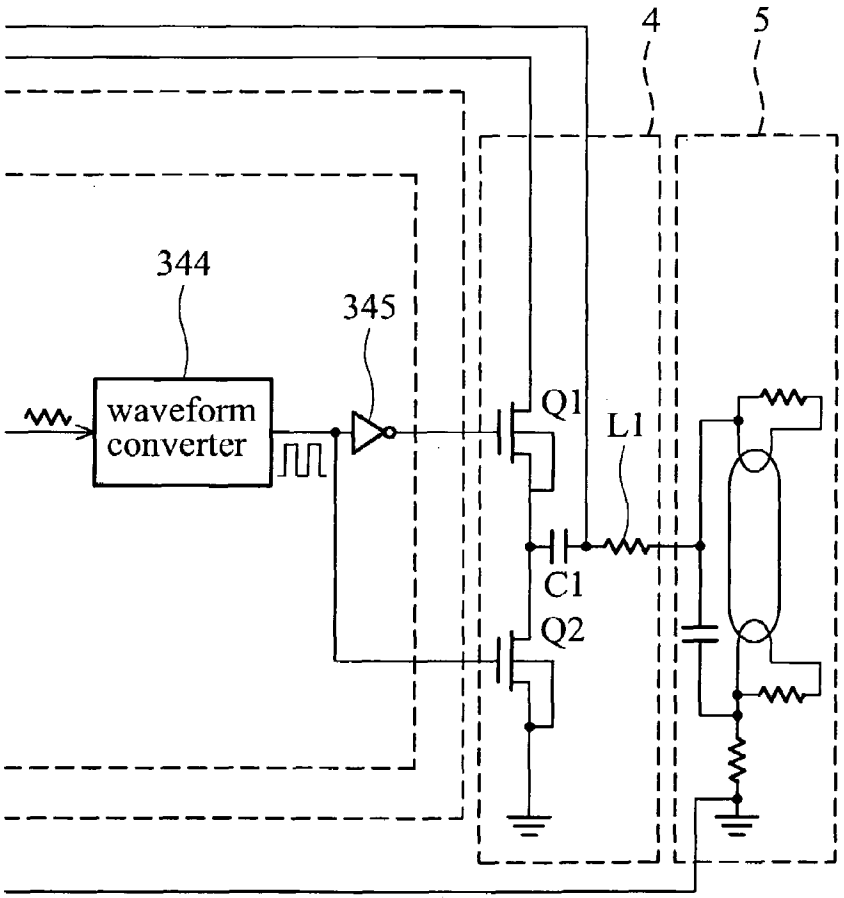

Referring to both FIG. 4 and FIGS. 5*a*-5*b*, a dimmer control system for controlling the illumination level of a fluorescent lamp comprises a SCR control circuit 1, a charge pump circuit 2, a RC attenuator 33, a control circuit 3 and a half bridge driving circuit 4.

The SCR control circuit 1 receives a first signal from the utility AC power and generates an adjustment signal. The charge pump circuit 2 is coupled to the SCR control circuit 1, receiving a charge pump signal, a second signal (from NEUTRAL of the utility power) and the adjustment signal to rectify and generate DC power for the fluorescent lamp. The RC attenuator 33 is also coupled to the SCR control circuit 1, attenuating the adjustment signal from the SCR control circuit 1, generating an attenuated DC signal.

In an embodiment, the AC power source may be a utility power source. The SCR control circuit 1 receives only the hot wire portion (LINE) of the utility power (AC power) and generates an adjustment signal, but bypasses the neutral wire portion (NEUTRAL). The charge pump circuit 2 receives the neutral wire portion (NEUTRAL) of the utility power (AC power) and a charge pump signal feedback by the fluorescent lamp 5, and, according to the adjustment signal output by the SCR control circuit 1, generates DC power. SCR control circuit 1 provides a channel bypasses the neutral wire portion (NEUTRAL) of the utility power (AC power) to the charge pump circuit 2. In other words, the SCR control circuit 1 is coupled to the AC power and uses hot wire portion (LINE) to generate the adjustment signal, then bypass the neutral wire (NEUTRAL) power signal to the charge pump circuit 2 without any change. The charge pump circuit 2 receives the adjustment signal adjusted by the SCR control circuit 1, the unchanged neutral wire (NEURAL) power signal and the charge pump signal feedback by the half bridge driving circuit 4 to generate DC power.

The control circuit 3 is coupled to the RC attenuator 33 and the fluorescent lamp 5, receives the attenuated DC signal, and generates a first output signal and a second output signal according to a first reference voltage VL, a second reference voltage Vh and a power feedback signal.

The control circuit 3 further comprises a hysteretic comparator 31, a subtractor 32 and a voltage controlled oscillator (VCO) 34. The hysteretic comparator 31 is coupled to the RC attenuator 33, receives the attenuated DC signal generated by the RC attenuator 33, and compares the first reference voltage and the second reference voltage with the attenuated DC signal to generate an enabling signal. The subtractor 32 is coupled to the RC attenuator 33, generating a dimming signal by adjusting the attenuated DC signal in response to the first reference voltage. The voltage controlled oscillator 34 is coupled to the hysteretic comparator 31, the subtractor 32 and the fluorescent lamp 5, generating first and second output signals by converting the dimming signal according to the enabling signal and a power feedback signal generated by the fluorescent lamp 5.

The VCO further comprises an amplifier 341, a current control circuit 342, a switch control circuit 343, a waveform converter 344 and an inverter 345. The amplifier 341 generates a frequency adjustment signal according to the dimming signal and the power feedback signal generated by the fluorescent lamp 5. The power feedback signal provides power information of the fluorescent lamp, and the power of the fluorescent lamp 5 is controlled by adjusting the dimming signal thereon. In one embodiment, the amplifier 341 may be an operational-transconductance amplifier (OTA).

The current control circuit 342 is coupled to the amplifier 341 to generate first and second currents according to the frequency adjustment signal. The switch control circuit 343 coupled to the current control circuit 342 and the hysteretic comparator 31 generates a triangle wave output signal according to the first current, the second current and the enabling signal. A waveform converter 344, coupled to the switch control circuit 345, converts the triangle wave output signal to the first output signal. The inverter 345, coupled to the waveform translator 344, receives the first output signal and generates the second output signal to the half bridge driving circuit 4. The waveform translator 344 converts the triangle wave output signal to first and second square-wave output signals.

The switch control circuit 343 comprises a capacitor and a switch device. The capacitor is connected to first current source in serial and coupled to second current source in parallel, generating the triangle wave output signal as charged and discharged by the first and the second current of the first and the second sources respectively. The switch device, coupled to the capacitor and the second current in parallel, controls charge and discharge of the capacitor by selectively turning on and off according to the enabling signal. When the enabling signal turns on the switch device, the capacitor is not charged or discharged. When the enabling signal turns off the switch device, the capacitor is charged or discharged. When the capacitor is not charged or discharged, the fluorescent lamp is off. When the capacitor is charged or discharged, the fluorescent lamp is on.

In this embodiment, the first reference voltage is the minimum voltage required to start the fluorescent lamp 5, and, when the first reference voltage exceeds the attenuated DC power signal, the enabling signal generated turns on the switch device. The second reference voltage is the minimum voltage required to restart the fluorescent lamp 5, and, when the attenuated DC power signal exceeds the second reference voltage, the enabling signal is disabled to turn off the switch device.

According to the hysteretic comparator 31, whether fluorescent lamp 5 is on or off is decided only by the enabling signal. The illumination of the fluorescent lamp 5, is nevertheless, controlled by the dimming signal generated by the subtractor 32. The DC power source of the fluorescent lamp 5 is provided by the DC power signal generated by the charge pump circuit 2.

The capacitor is charged or discharged responsive to the values and the directions of the first and second current generated by the current control circuit 342 such that the triangle wave output signal is generated. The enabling signal only controls the switch device to turn on or turn off and further controls whether to charge or discharge the capacitor, but does not determine the frequency of the output voltage. The frequency of the triangle wave output signal is determined by the first and second current sources output from the current control circuit 342.

The half bridge driving circuit 4, coupled to charge pump circuit 2, control circuit 3 and fluorescent lamp 5, receives the first output signal, the second output signal and the DC power signal to generate an illuminating signal and the charge pump signal. The illumination level of the fluorescent lamp 5 can be adjusted by the illuminating signal. In this embodiment, a frequency adjustment signal generated according to the dimming signal and the power feedback signal from the fluorescent lamp 5 controls current through the inductor in the half bridge driving circuit 4, e.g. the current of the fluorescent lamp 5, and further adjusts the output power of the fluorescent lamp 5.

The dimming signal and the power feedback signal of the fluorescent lamp 5 are sent to the amplifier 341 in the VCO 34, which accordingly alters the value of the frequency adjustment signal and, accordingly, the frequency output for the VCO 34. The half bridge driving circuit 4 receives the first and second output signals from the VCO 34, controlling current through the extra inductor L1, and generates the illuminating signal to the fluorescent lamp 5. A different value of the illuminating signal corresponds to a different current through L1 and changes the illumination level of the fluorescent lamp 5 accordingly. Thus, attenuated DC signal and power feedback signal of fluorescent lamp 5 affect the output frequency of the VCO 34, and further determine the current through the half bridge driving circuit 4 and the inductor L1. The illumination of the fluorescent lamp 5 is controlled by the current therethrough and the dimmer control system is achieved.

In one embodiment, the half bridge driving circuit 4 also generates to the charge pump circuit 2 a charge pump signal according to the first output signal, the second output signal and the DC power signal, such that a charge pump circuit is formed in the charge pump circuit 2. The charge pump circuit 2 can continuously generate the adjustment signal according to the charge pump signal.

The operation of the charge pump circuit is described as follows. In SCR control circuit 1, the voltages across the SCR must reach a triggering voltage and a holding current is required through the SCR after it is triggered, otherwise the SCR is turned off. Accordingly, current must be kept higher than the holding current until the end of the half primary cycle after the SCR is triggered. For this purpose, the sink current of an electronic dimmer ballast must exceeds the holding current of different standard commercial power bi-directional SCRs applied in the dimmer design, for example. Therefore, a charge pump circuit is added into the charge pump circuit 2 to keep the SCR turned on. When operating, once the switch device Q2 is turned on, voltage between the inductor L1 and the capacitor C1 drops to a minimum value, causing the capacitor C2 to charge through diode D2 during the positive half cycle of the primary voltage. When switch Q2 is turned off and switch Q1 is turned on, voltage between the inductor L1 and the capacitor C1 rises to a maximum value, and C2 is discharged to charge capacitor C4 through the diode D1. During the negative half cycle of the primary voltage, the operation of capacitors C3 and C5 are similar to the operation of capacitors C1 and C4, but with opposite polarities. As a result, a continuous input current pulse is provided after the SCR is triggered until the end of the half cycle of the primary voltage. Again, the arrangement of the charge pump circuit is well known in the art, and details thereof omitted herefrom.

The invention also provides a method for controlling the illumination level of a fluorescent lamp. The method comprises generating an adjustment signal by receiving a first signal of a power source, generating a DC power signal by rectifying a second signal of the power source and the adjustment signal according to a charge pump signal providing DC power to the fluorescent lamp, attenuating the adjustment signal to generate an attenuated DC signal, generating a first output signal and a second output signal by processing the attenuated DC signal according to a first reference voltage, a second reference voltage and a power feedback signal of the fluorescent lamp, and generating an illuminating signal and charge pump signal according to the first output signal, the second output signal and the DC power signal. The illumination level of the fluorescent lamp is adjustable by the illuminating signal.

Generation of output signals may also comprise generating an enabling signal by comparing the first and second reference voltages with the attenuated DC signal, generating an illuminating signal by adjusting the attenuated DC signal according to the first reference voltage, and generating the first and second output signals by converting the illuminating signal according to the enabling signal and the power feedback signal.

A DC signal may further be generated to control the frequency according to the illuminating signal and the power feedback signal generated by the fluorescent lamp, a first current and a second current may be generated according to the DC signal to control the frequency, a square-wave output signal of a frequency is generated according to the first current, the second current and the enabling signal, the square-wave output signal is converted to the first output signal, and the second output signal is sent to a half bridge driving circuit according to the first output signal.

The square-wave output signal may further be generated by charging or discharging a capacitor according to the first current and second current sources, and charge and discharge of the capacitor is controlled by selectively turning on and off a switch according to the enabling signal The dimmer control system and controlling apparatus for controlling the illumination of a fluorescent lamp adds a control circuit to prevent the repeat restart problems in conventional fluorescent lamps. Furthermore, with the use of the subtractor, dimming range sacrificed by adding the control circuit is compensated. Effective control of the illumination level of the fluorescent lamp is achieved and the dimming range is not reduced.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dimmer control system for controlling illumination of a fluorescent lamp, comprising:

a silicon controlled rectifier (SCR) control circuit receiving a first signal of a power source and generating an adjustment signal;

a charge pump circuit coupled to the SCR control circuit, receiving a charge pump signal, a second signal of the power source and the adjustment signal to accordingly generate a direct current (DC) power signal;

a RC attenuator coupled to the SCR control circuit, attenuating the adjustment signal to generate an attenuated DC signal;

a control circuit coupled to the RC attenuator and the fluorescent lamp, receiving the attenuated DC signal and generating a first output signal and a second output signal according to a first reference voltage, a second reference voltage and a power feedback signal of the fluorescent lamp; and a half bridge driving circuit coupled to the charge pump circuit, the control circuit and the fluorescent lamp, receiving the first output signal, the second output signal and the DC power signal to generate an illuminating signal and the charge pump signal;

wherein the illumination level of the fluorescent lamp is adjustable by the illuminating signal.

2. The dimmer control system as claimed in claim 1, wherein the control circuit further comprises:

a hysteretic comparator coupled to the RC attenuator, generating an enabling signal by comparing the first reference voltage and the second reference voltage with the attenuated DC signal;

a subtractor coupled to the RC attenuator, generating a dimming signal by adjusting the attenuated DC signal according to the first reference voltage; and a voltage controlled oscillator (VCO) coupled to the hysteretic comparator, the subtractor and the fluorescent lamp, converting the dimming signal to the first and the second output signals according to the enabling signal and the power feedback signal.

3. The dimmer control system as claimed in claim 2, wherein the VCO further comprises:

an amplifier generating a frequency adjusting signal according to the dimming signal and the power feedback signal generated by the fluorescent lamp;

a current control circuit coupled to the amplifier, generating a first current and a second current according to the frequency adjusting signal;

a switch control circuit coupled to the current control circuit and the hysteretic comparator, generating an output signal according to the first current, the second current and the enabling signal;

a waveform converter, coupled to the switch control circuit, converting the output signal to the first output signal; and an inverter, coupled to the waveform converter, generating the second output signal to the half bridge driving circuit by receiving the first output signal.

4. The dimmer control system as claimed in claim 3, wherein the switch control circuit comprises:

a capacitor, connected to a first current source generating the first current in serial and coupled to a second current source generating the second current in parallel, generating the output signal by being charged or discharged using the first and the second currents; and a switch device coupled to the capacitor and the second current source in parallel, controlling charge and discharge of the capacitor by selectively turning on and off according to the enabling signal.

5. The dimmer control system as claimed in claim 4, wherein the first reference voltage is the minimum voltage required to start the fluorescent lamp, and the enabling signal is generated to turn on the switch device when the first reference voltage exceeds the attenuated DC signal.

6. The dimmer control system as claimed in claim 4, wherein the second reference voltage is the minimum voltage required to restart the fluorescent lamp, and the enabling signal is disabled to turn off the switch device when the attenuated DC signal exceeds the second reference voltage.

7. A controlling apparatus for controlling illumination of a fluorescent lamp for a built-in electronic dimmer ballast, which comprises a charge pump circuit, a RC attenuator and a half bridge driving circuit, wherein a SCR control circuit generates an adjustment signal by adjusting a first signal of a power source, the RC attenuator receives the adjustment signal and generates an attenuated direct current (DC) signal, the charge pump circuit generates a DC power signal by receiving a second signal of the power source, the adjustment signal and a charge pump signal from the half bridge driving circuit, and the half bridge driving circuit generates the charge pump signal and an illuminating signal controlling illumination of the fluorescent lamp according to the DC power signal, a first output signal and a second output signal generated by the controlling apparatus, the controlling apparatus comprising:

a hysteretic comparator coupled to the RC attenuator, generating an enabling signal by comparing a first reference voltage and the second reference voltage with the attenuated DC signal;

a subtractor coupled to the RC attenuator, generating a dimming signal by adjusting the attenuated DC signal in response to the first reference voltage; and a voltage controlled oscillator (VCO) coupled to the hysteretic comparator, the subtractor and the fluorescent lamp, converting the dimming signal to the first and the second output signals according to the enabling signal and a power feedback signal generated from the fluorescent lamp.

8. The controlling apparatus as claimed in claim 7, the voltage controlled oscillator further comprising:

an amplifier generating a frequency adjusting signal according to the power feedback signal and the dimming signal;

a current control circuit coupled to the amplifier, generating first and second currents according to the frequency adjusting signal;

a switch control circuit coupled to the current control circuit and the hysteretic comparator, generating an output signal according to the first current, the second current and the enabling signal;

a waveform converter, coupled to the switch control circuit, converting the output signal to the first output signal; and an inverter, coupled to the waveform converter, generating the second output signal by receiving the first output signal.

9. The controlling apparatus as claimed in claim 8, wherein the switch control circuit comprises:

a capacitor, connected in serial to a first current source generating the first current and in parallel to a second current source generating the second current, generating the output signal by charging or discharging using the first and second current sources; and a switch device coupled to the capacitor and the second current source in parallel, controlling charge and discharge of the capacitor by selectively turning on and off according to the enabling signal.

10. The controlling apparatus as claimed in claim 7, wherein the first reference voltage is the minimum voltage required to start the fluorescent lamp, and the enabling signal is generated to turn on the switch device when the first reference voltage exceeds the attenuated DC signal.

11. The controlling apparatus as claimed in claim 7, wherein the second reference voltage is the minimum voltage required to restart the fluorescent lamp, and the enabling signal is disabled to turn off the switch device when the attenuated DC signal exceeds the second reference voltage.

12. A method for controlling illumination of a fluorescent lamp, the controlling method comprising:

(a) generating an adjustment signal by receiving a first signal of a power source;

(b) generating a DC power signal by rectifying a second signal of the power source and the adjustment signal according to a charge pump signal;

(c) attenuating the adjustment signal to generate an attenuated DC signal;

(d) generating first and second output signals by processing the attenuated DC signal according to a first reference voltage, a second reference voltage and a power feedback signal of the fluorescent lamp; and (e) generating an illuminating signal and the charge pump signal according to the first output signal, the second output signal and the DC power signal;

wherein illumination of the fluorescent lamp is adjustable by the illuminating signal.

13. The method as claimed in claim 12, wherein step (d) further comprises:

(d1) generating an enabling signal by comparing the first and the second reference voltages with the attenuated DC signal;

(d2) generating an illuminating signal by adjusting the attenuated DC signal according to the first reference voltage; and (d3) generating the first and the second output signals by converting the illuminating signal according to the enabling signal and the power feedback signal.

14. The method as claimed in claim 13, wherein step (d3) further comprises:

(d31) generating a frequency adjusting signal according to the illuminating signal and the power feedback signal generated by the fluorescent lamp;

(d32) generating a first current and a second current according to the frequency adjusting signal;

(d33) generating an output signal according to the first current, second current and the enabling signal;

(d34) converting the output signal to the first output signal; and (d35) generating the second output signal to the half bridge driving circuit according to the first output signal.

15. The method as claimed in claim 14, wherein the step (d33) further comprises the steps of:

(d331) generating the output signal by charging or discharging a capacitor according to the first current and second current sources; and (d332) controlling charge and discharge of the capacitor by selectively turning on and off a switch device according to the enabling signal.

16. The method as claimed in claim 15, wherein the first reference voltage is the minimum voltage required to turn on the fluorescent lamp, and the enabling signal is generated to turn on the switch device when the first reference voltage exceeds the attenuated DC signal.

17. The method as claimed in claim 15, wherein the second reference voltage is the minimum voltage required to restart the fluorescent lamp, and the enabling signal is disabled to turn off the switch device when the attenuated DC signal exceeds the second reference voltage.

* * * * *